US006595017B1

(12) United States Patent
Teahan

(10) Patent No.: US 6,595,017 B1
(45) Date of Patent: Jul. 22, 2003

(54) SYSTEM FOR SHADING AIR CONDITIONING UNITS AND METHOD FOR INSTALLING THE SAME

(76) Inventor: Matt Teahan, 6447 E. Raftriver St., Mesa, AZ (US) 85215

( * ) Notice: Subject to any disclaimer, the term of this patent is extended or adjusted under 35 U.S.C. 154(b) by 0 days.

(21) Appl. No.: 10/150,443

(22) Filed: May 17, 2002

(51) Int. Cl.[7] ..... F25D 23/12

(52) U.S. Cl. ..... 62/259.1; 62/DIG. 13; 62/305; 52/71

(58) Field of Search ..... 62/259.1, 259.2, 62/305, 304, DIG. 13; 135/913; 52/74, 71; 206/320; 165/134.1; 160/205, 207, 216, 217

(56) References Cited

U.S. PATENT DOCUMENTS

| | | | | | |
|---|---|---|---|---|---|
| 2,901,989 | A | | 9/1959 | Mondi | |
| 2,914,075 | A | | 11/1959 | Wells et al. | |
| 2,941,380 | A | | 6/1960 | Garred | |
| 3,379,481 | A | * | 4/1968 | Fisher | 312/100 |
| 4,498,912 | A | * | 2/1985 | Wagner | 62/DIG. 16 |
| 4,615,181 | A | | 10/1986 | Greenwood | |
| 4,768,350 | A | * | 9/1988 | Moran, Jr. | 62/259.1 |
| 4,953,328 | A | | 9/1990 | Sewell et al. | |
| 5,097,678 | A | | 3/1992 | Aubuchon | |
| 5,226,264 | A | | 7/1993 | Walters | |
| 5,307,849 | A | | 5/1994 | Nelson | |
| 5,655,382 | A | | 8/1997 | Chen | |
| 6,158,175 | A | * | 12/2000 | Carter | 52/71 |

FOREIGN PATENT DOCUMENTS

| | | |
|---|---|---|
| JP | 11159809 A | 6/1999 |

* cited by examiner

*Primary Examiner*—Chen Wen Jiang
(74) *Attorney, Agent, or Firm*—Paul D. Amrozowicz, Esq.

(57) ABSTRACT

A system for shading an air conditioning unit from sunlight uses one or more sheets of solar screen material attached to a frame. The frame is coupled to the air conditioning unit using various bracketing arrangements. The system is easy to install, does not significantly restrict air flow, is adjustable, and is attached directly to the air conditioning unit.

13 Claims, 6 Drawing Sheets

SYSTEM FOR SHADING AIR CONDITIONING UNITS AND METHOD FOR INSTALLING THE SAME

BACKGROUND OF THE INVENTION

1. Field of the Invention

The present invention relates to a system for increasing the efficiency of outdoor air conditioning units and, more particularly, to a system for shading the air conditioning units from direct sunlight.

2. Description of Related Art

Outdoor air conditioning units may typically include a compressor, a condenser, various piping and valves, and a fan, all contained within a housing. The purpose of the air conditioning unit is to transfer the heat from a building or structure to refrigerant in the air conditioning system piping, and then reject this heat to the ambient environment outside of the building or structure.

Many air conditioning units, most notably those used for residential cooling, may be located outdoors, adjacent to, or nearby, the residence. As a result, the air conditioning unit may be exposed to direct sunlight. This exposure can increase the temperature of the air conditioning unit and its internal components. This can reduce the heat transfer rate from the air conditioning unit, and significantly impact the air conditioning unit's efficiency.

Various devices and methods have been proposed in the past to shade air conditioning units from direct sunlight. However, these devices and methods suffer certain drawbacks. For example, some devices are not readily useful with operating air conditioning units, since air flow through the devices may be restricted. Some devices are not readily attachable to, and/or detachable from, the air conditioning unit. Other devices are not readily adjustable once the screens are installed, which means that the positioning of the devices may not be readily changed to adapt to sun angle variations, and/or to optimize airflow around the devices and into the air conditioning unit. Still other units use latches that frictionally engage the concrete slab on which the air conditioning unit is installed, which may not be as reliable as attaching the screen(s) directly to the air conditioning unit.

Hence there is a need for a system of shading air conditioning units that addresses one or more of the above-noted drawbacks. Namely, a system that screens the unit but does not restrict air flow to or from the unit, and/or that is readily adjustable once it is attached, and/or is readily attached to the unit. The present invention addresses one or more of these needs.

SUMMARY OF THE INVENTION

The present invention provides a system for shading air conditioning units that is easy to install, does not significantly restrict air flow, is adjustable, and attached directly to the air conditioning unit.

In one embodiment of the present invention, and by way of example only, a system for shading an air conditioning unit from sunlight includes at least one frame, at least one sheet of solar screen material, at least one rotating bracket assembly, and at least one adjustable length bracket assembly. The sheet of solar screen material is coupled to the frame. The rotating bracket assembly is coupled to a first portion of the frame to rotationally couple the first portion of the frame to the air conditioning unit. The adjustable length extension bracket assembly is coupled to a second portion of frame to adjustably space the second portion of the frame a predetermined distance from the air conditioning unit.

In another exemplary embodiment, a system for shading an air conditioning unit from sunlight includes at least one frame, at least one sheet of solar screen material, and at least two brackets. The sheet of solar screen material is coupled to the frame. Each bracket is adapted to slidably receive at least a portion of the frame therein and to couple the bracket to the air conditioning unit.

In yet another exemplary embodiment, a kit for modifying an air conditioning unit to include a system for shielding the air conditioning unit from sunlight includes at least one frame, at least one sheet of solar screen material, at least one rotating bracket assembly adapted for rotationally coupling a first portion of the frame to the air conditioning unit, and at least one adjustable extension bracket assembly adapted for coupling a second portion of frame to the air conditioning unit.

In still a further exemplary embodiment, a kit for modifying an air conditioning unit to include a system for shading the air conditioning unit from sunlight includes at least one frame, at least one sheet of solar screen material, and at least two brackets, each of which are adapted to slidably receive at least a portion of the frame therein and to couple the bracket to the air conditioning unit.

In yet a further exemplary embodiment, a method of installing a system for shading an air conditioning unit from sunlight includes providing at least one frame having at least one sheet of solar screen material coupled thereto, providing at least one rotating bracket assembly adapted for rotationally coupling a first portion of the frame to the air conditioning unit, and providing at least one adjustable length extension bracket assembly adapted for coupling a second portion of frame to the air conditioning unit. The rotating bracket and adjustable length extension bracket assemblies are each coupled to the air conditioning unit, the rotating bracket assembly is coupled to the frame first portion, and the adjustable extension bracket assembly is coupled to the frame second portion.

In yet still a further exemplary embodiment, a method of installing a system for shading an air conditioning unit from sunlight includes providing at least one frame having at least one sheet of solar screen material coupled thereto, providing at least two brackets adapted for coupling to the air conditioning unit, each bracket including a first portion adapted to slidably receive at least a portion of the frame therein. The brackets are coupled to the air conditioning unit, and the frame is slidably inserted into the first portion of each of the brackets.

Other independent features and advantages of the preferred shading system and installation method will become apparent from the following detailed description, taken in conjunction with the accompanying drawings which illustrate, by way of example, the principles of the invention.

DETAILED DESCRIPTION OF VARIOUS EMBODIMENTS

Figure 1:
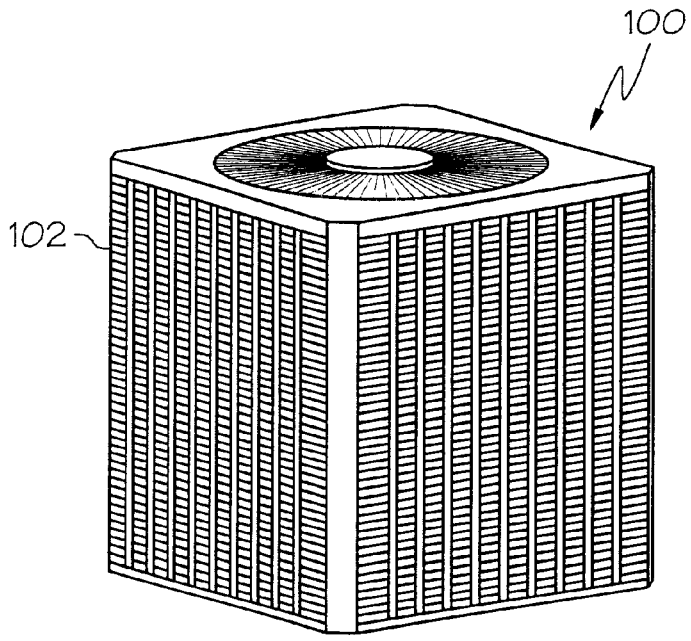
FIG. 1 is a perspective view of an air conditioning unit that may be used with the shading system of the present invention.

A perspective view of an embodiment of an air conditioning unit that may be used with the shading system of the present invention is depicted in FIG. 1. The air conditioning unit 100 is any one of numerous known air conditioners or heat pumps known in the art, and includes various non-illustrated components such as, for example, a compressor, a condenser, various piping and valves, and a fan, all enclosed within a housing 102.

Figure 2:
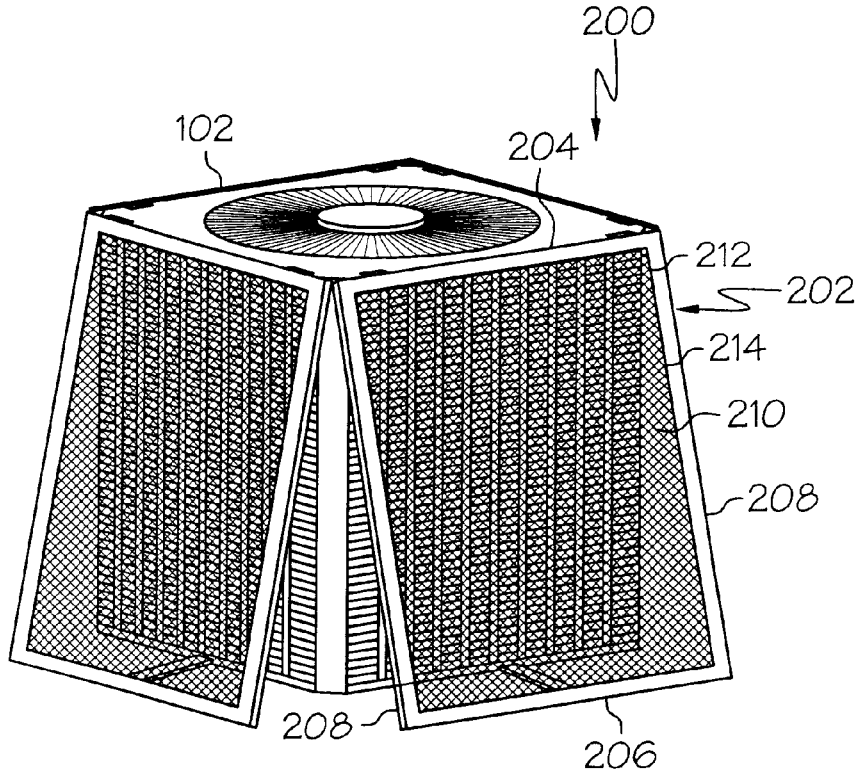
FIG. 2 is a perspective view an the air conditioning unit shown in FIG. 1 with an exemplary embodiment of the shading system of the present invention installed.

The air conditioning unit 100 is typically installed outdoors on, for example, a concrete foundation (not illustrated). Thus, as depicted in FIG. 2, to shield the housing 102 from the sun's rays, a shading system 200 according to one embodiment of the present invention is installed on the unit 100. The shading system 200 includes at least one frame 202. It should be appreciated that the number of frames 200 may be varied to shade as much of the housing 102 as desired. For example, if the air conditioning unit 100 is installed such that only one side of the housing 102 is exposed to sunlight, then only the number of panels (preferably only one) needed to shade that one side of the housing 102 will likely be installed. It should be additionally appreciated that the frame 200 may be formed into any suitable shape and size. However, in the preferred embodiment depicted in FIG. 2, the frame is rectangular or square in shape, depending on the shape of the housing sides, and has a top 204, a bottom 206, and two sides 208. In addition, the frame 202 is preferably sized so that substantially one entire side of the air conditioning unit 100 is shaded when the frame 202 is coupled to the housing 102. The frame 202 may be manufactured from any suitably rigid material such as, for example, wood, stainless steel, and fiberglass, but is preferably manufactured from anodized aluminum.

A sheet of solar screen material 210 is coupled to the frame 202. The solar screen material 210 may be any one of numerous mesh-type materials of various deflective ratings that are known in the art for deflecting the sun's rays. Preferably, however, the screen material 210 is at least 90-degree highly solar deflective shading mesh. The solar screen material 210 may be coupled to the frame 202 using any one of numerous known devices and methods. For example, the material 210 could be coupled to the frame 202 using various fasteners such as, for example, staples, screws, or nails. Alternatively, an adhesive such as, for example, double-sided tape, epoxy, or glue, could also be used. In the preferred embodiment, however, the material 210 is coupled to the frame by press fitting one or more rubber strips 212 into a groove 214 formed near the inner periphery of each frame 202. It will additionally be appreciated that more than one sheet of solar screen material 210 may be coupled to the frame 202 to provide additional shading.

Figure 3:
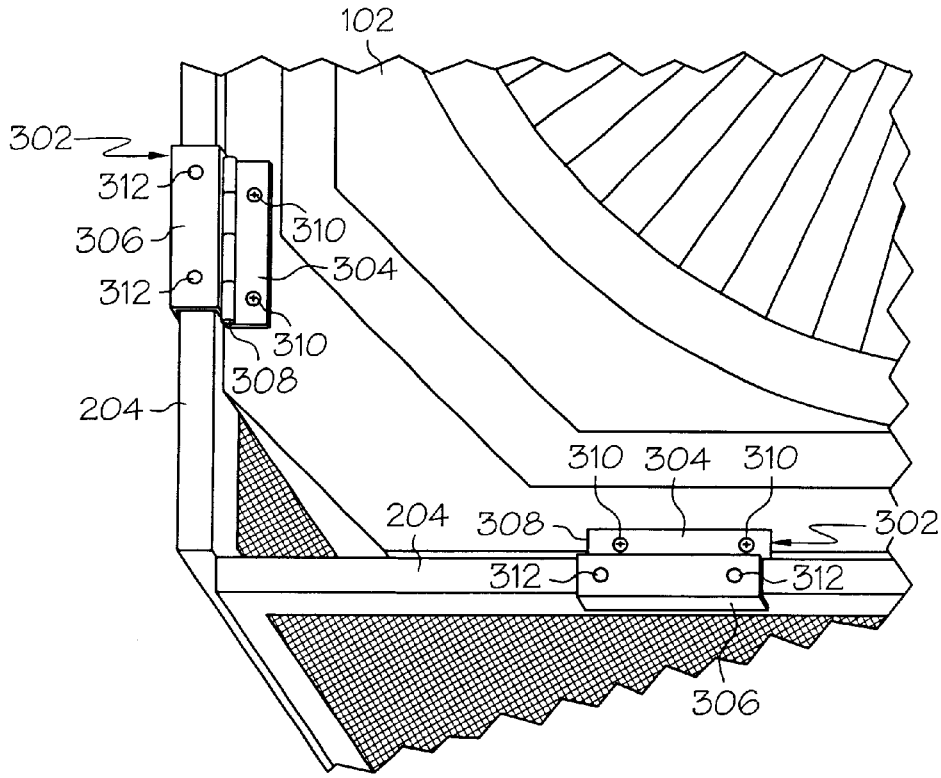
FIG. 3 is a top view of a portion of the air conditioning unit shown in FIG. 2, which illustrates an exemplary bracketing arrangement for coupling the top portion of the shading system to the air conditioning unit.

Each frame 202 is preferably coupled to the housing 102 using at least two different bracket assemblies. In the depicted embodiment, one bracket assembly is coupled to the top 204 of the frame 202, and a second bracket assembly is mounted to the bottom 206 of the frame 208. As illustrated more clearly in FIG. 3, a rotating bracket assembly 302 is coupled to the top 204 of the frame 202. This rotating bracket assembly 302 includes a first housing attachment plate 304, a first frame attachment brace 306, and a first hinge 308. The first housing attachment plate 304 couples the bracket assembly 302 to the housing 102 preferably using one or more threaded fasteners such as, for example, screws 310. The first frame attachment brace 306 is substantially U-shaped in cross-section and is dimensioned to snap-fit onto the top 204 of the frame 202. The first frame attachment brace 306 may additionally include one or more openings 312, which allows the first brace 306 to be additionally secured to the frame 202 using one or more screws (non-illustrated). The first hinge 308 rotationally couples the first attachment plate 304 and first frame attachment brace 308 together. Thus, when the frame 202 is coupled to the housing 102 using the rotating bracket assembly 302, the frame 202 may be rotated outwardly, away from the side of the housing 102 that it covers. It will be appreciated that the bracket assembly 302 depicted and described herein is merely exemplary of a preferred embodiment and that numerous other rotating bracket assemblies of differing configurations may also be used.

Figure 4:
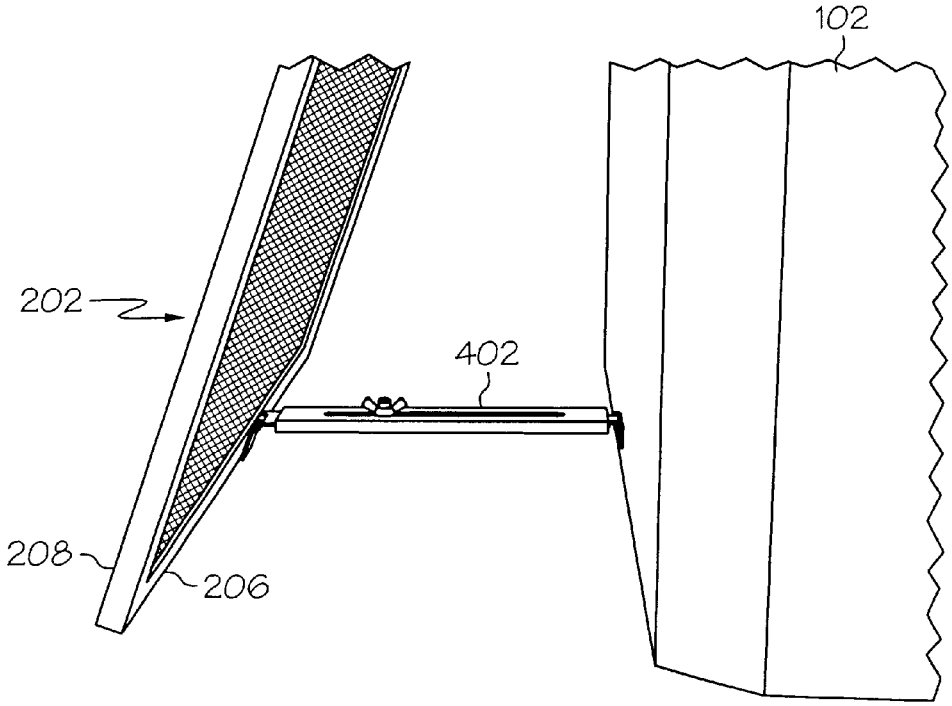
FIG. 4 is a side view of a portion of the air conditioning unit shown in FIG. 2, which illustrates an exemplary bracketing arrangement for coupling the bottom portion of the shading system to the air conditioning unit.
Figure 5:
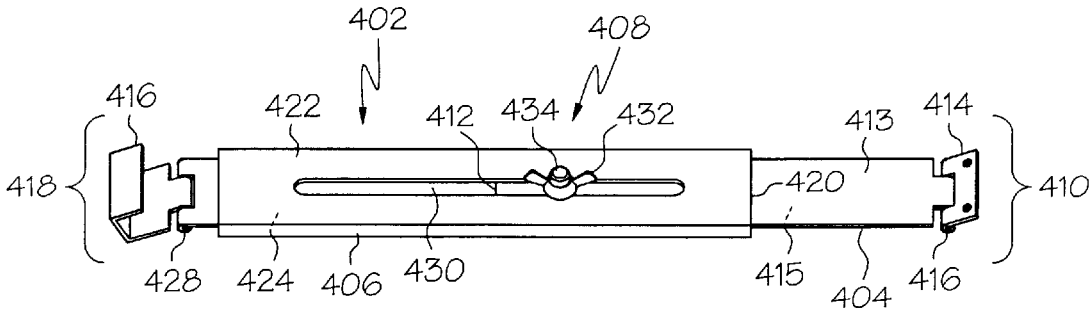
FIG. 5 is perspective view of an exemplary bracket used in the arrangement depicted in FIG. 4 for coupling the bottom portion of the shading system to the air conditioning unit.

Turning now to FIGS. 4 and 5, it can be seen that the second bracket assembly is an adjustable length extension bracket assembly 402. The extension bracket assembly 402, as was noted above, is preferably coupled between the bottom 206 of the frame 202 and the housing 102. The extension bracket assembly 402 is configured such that its length is adjustable to a predetermined, desired position, and held in place in this position. This allows the shading system 200 to provide sufficient shading without substantially obstructing air flow into the unit 100, or being sucked up against the housing 102 while the unit 100 is operating. As shown more clearly in FIG. 5, in the preferred embodiment, the extension bracket assembly 402 includes a first bracket 404, a second bracket 406, and fastener hardware 408. The first bracket 404 has a first end 410, a second end 412, a top surface 413, and a bottom surface 415. The first end 410 is adapted for coupling the first bracket 404 to the air conditioning unit housing 102. In the preferred embodiment, this is done by rotationally coupling a second housing attachment plate 414 to the first bracket first end 410, preferably via a second hinge 416. The second housing attachment plate 414, similar to the first housing attachment plate 304, couples the first bracket 404 to the housing 102 preferably using one or more threaded fasteners such as, for example, screws.

The second bracket 406, similar to the first bracket 404, includes a first end 418, a second end 420, a top surface 422, and a bottom surface 424. The second bracket first end 418 is adapted for coupling the second bracket 406 to the frame 202. In the preferred embodiment, this is done by rotationally coupling a second frame attachment brace 426 to the second bracket first end 418, preferably via a third hinge 428. The second frame attachment brace 426 is configured similar to the first attachment brace 306. Thus, it is substantially U-shaped in cross section and is dimensioned to snap fit onto the bottom 206 (or other portion) of the frame 202. Similar to the first attachment brace 306, the second attachment brace 326 may also include one or more openings, which allows the second attachment brace 426 to be additionally secured to the frame 202 using one or more screws (unillustrated). The second bracket 406 additionally includes a slot 430 formed through it between the top 422 and bottom 424 surfaces, and that extends from a first predetermined position proximate the first end 418 to a second predetermined position proximate the second end 420. It will be appreciated that the first and second predetermined positions may be any one of numerous positions along the length of the second bracket 406, depending upon the lengths it is desired to have the adjustable length extension bracket assembly 402 adjustable between.

The fastener hardware 408, which in the depicted embodiment is a threaded stud 432 and wing nut 434 combination, is coupled to the first bracket 404 and is used to secure the first 404 and second 406 brackets at predetermined positions relative to one another. In particular, the threaded stud 418 extends through the slot 430, and then when the first 404 and second 406 brackets are adjusted so that the extension bracket assembly 402 is at a desired length, the wing nut 434 is threaded around the stud and tightened against the second bracket top surface 422. Thus, the first 404 and second 406 brackets are held in place in their relative positions. In the preferred embodiment, the threaded stud 432 is attached to the first bracket 404 by, for example, a welding process. It will be appreciated that the stud 432 need not be attached to the first bracket 404 and could instead be inserted through an aperture formed in the first bracket 404.

As FIG. 5 additionally illustrates, in the preferred embodiment, the first 404 and second 406 brackets are each substantially U-shaped in cross section, and the first bracket 404 slidingly moves within the U-shaped cross section of the second bracket 406 to adjust the extension bracket assembly 402 to the desired length. It will be appreciated that this cross sectional shape is merely exemplary of a preferred embodiment, and that other cross sectional shapes could also be used. Additionally, while the first bracket 404 slides within the second bracket 406, it should be appreciated that the brackets could be configured oppositely. That is, the brackets could be configured such that the second bracket 406 slides within the first bracket 404. Moreover, while in the preferred embodiment the fastener hardware 408 is included with the first bracket 404 and the slot 430 is included in the second bracket 406, it should be appreciated that the present invention is not limited to this configuration. For example, the slot 430 could be formed in the first bracket 404 and the fastener hardware 408 could be included with the second bracket 406. It should additionally be appreciated that the use of a threaded stud 432 and nut 434 is only exemplary of the preferred configuration for holding the extension bracket assembly 402 at a predetermined length, and that various other configurations for performing this same function could be used.

Figure 6:
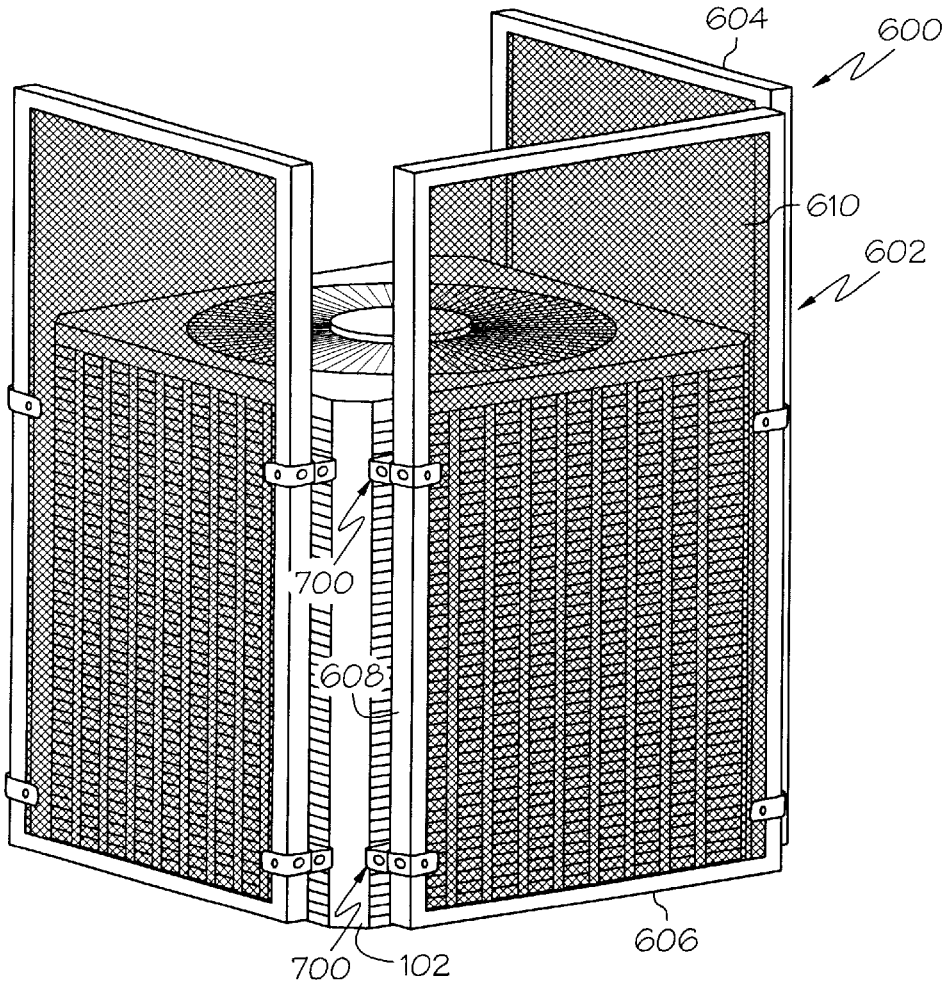
FIG. 6 is a perspective view of an alternative embodiment of the shading system coupled to the air conditioning unit depicted in FIG. 1.
Figure 7:
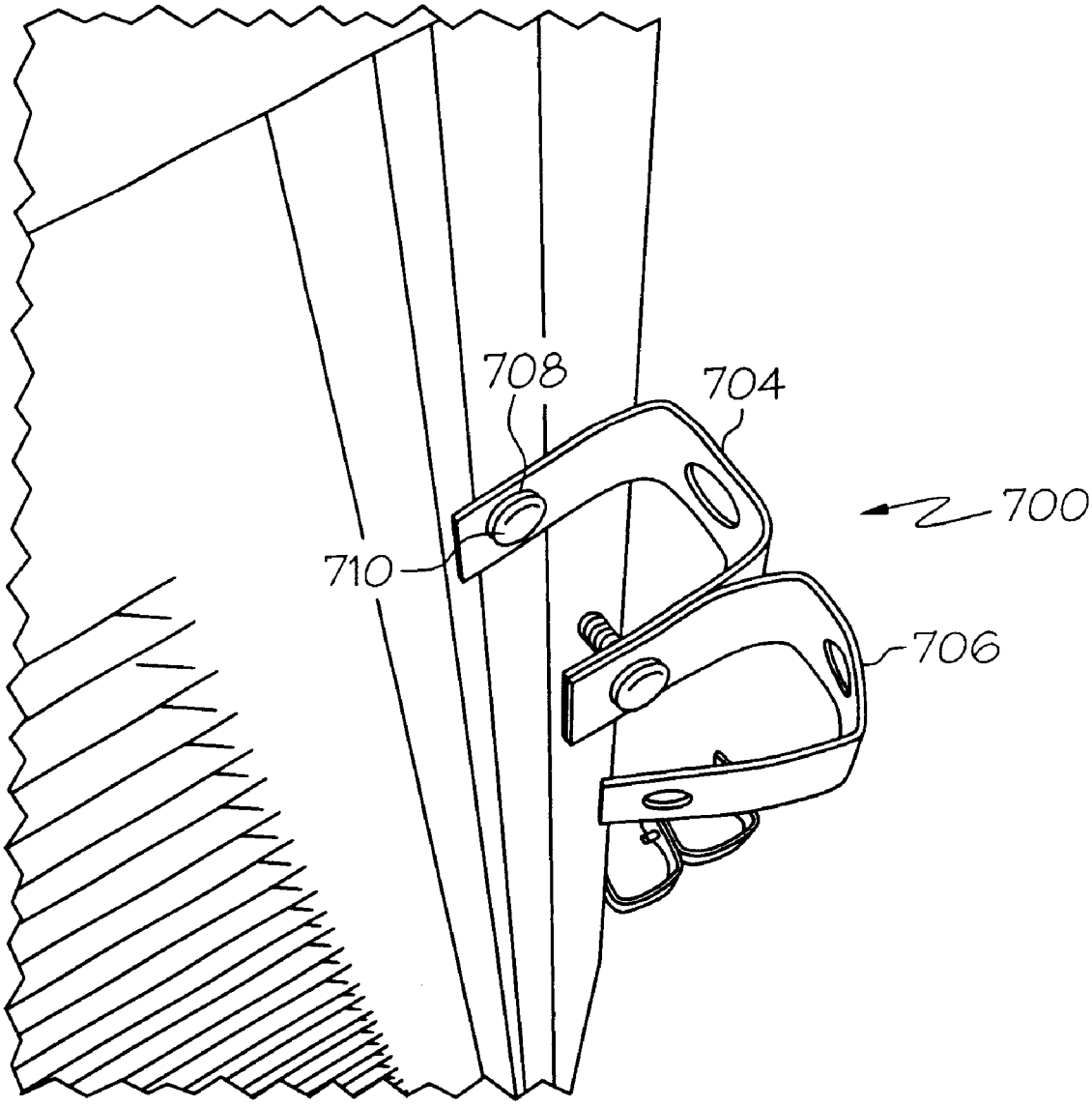
FIG. 7 is a perspective view of an exemplary bracketing arrangement used with the alternate system depicted in FIG. 6.

With reference now to FIG. 6, an alternative embodiment of a shading system will be described. This shading system 600, like the previous system 200, includes at least one frame 602 with one or more sheets of solar screen material 610 coupled to it. The frame 602 and material 610 may be shaped and manufactured similar to the first system 200, and will therefore not be further described in detail. With this alternate system 600, however, each frame 602 is coupled to the housing 102 using a different type of bracketing arrangement. In particular, as illustrated more clearly in FIG. 7, the bracket 700 used to couple the frame 602 to the housing 100 includes a mounting section 704 and a frame clamping section 706. The mounting section 704 is used to couple the bracket 700 to the housing 100, and preferably includes an opening 708 through which a threaded fastener 710 may be installed. The frame clamping section 706 is generally U-shaped in cross-section and is dimensioned to slidably receive the frame 602. Preferably, as shown more clearly in FIG. 6, two brackets 700 are used to couple each side 608 of the frame 602 to the housing 102, though it should be appreciated that more or less than two per side could also be used. With this particular configuration, the frame 602 may be readily slid into and out of the brackets 700.

Figure 8:
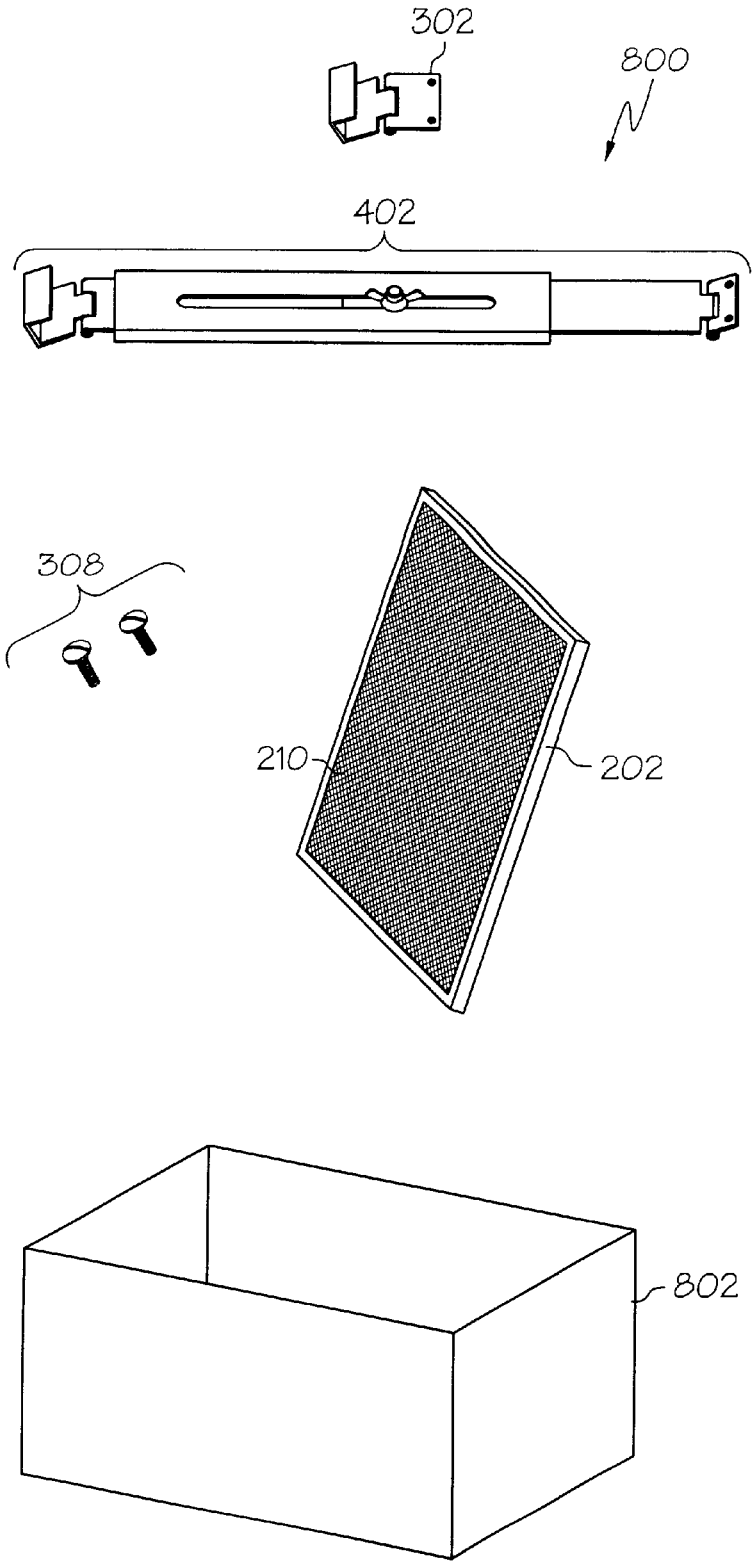
FIG. 8 illustrates an exploded view of an exemplary embodiment of a kit that may be used to modify the air conditioning unit depicted in FIG. 1.
Figure 9:
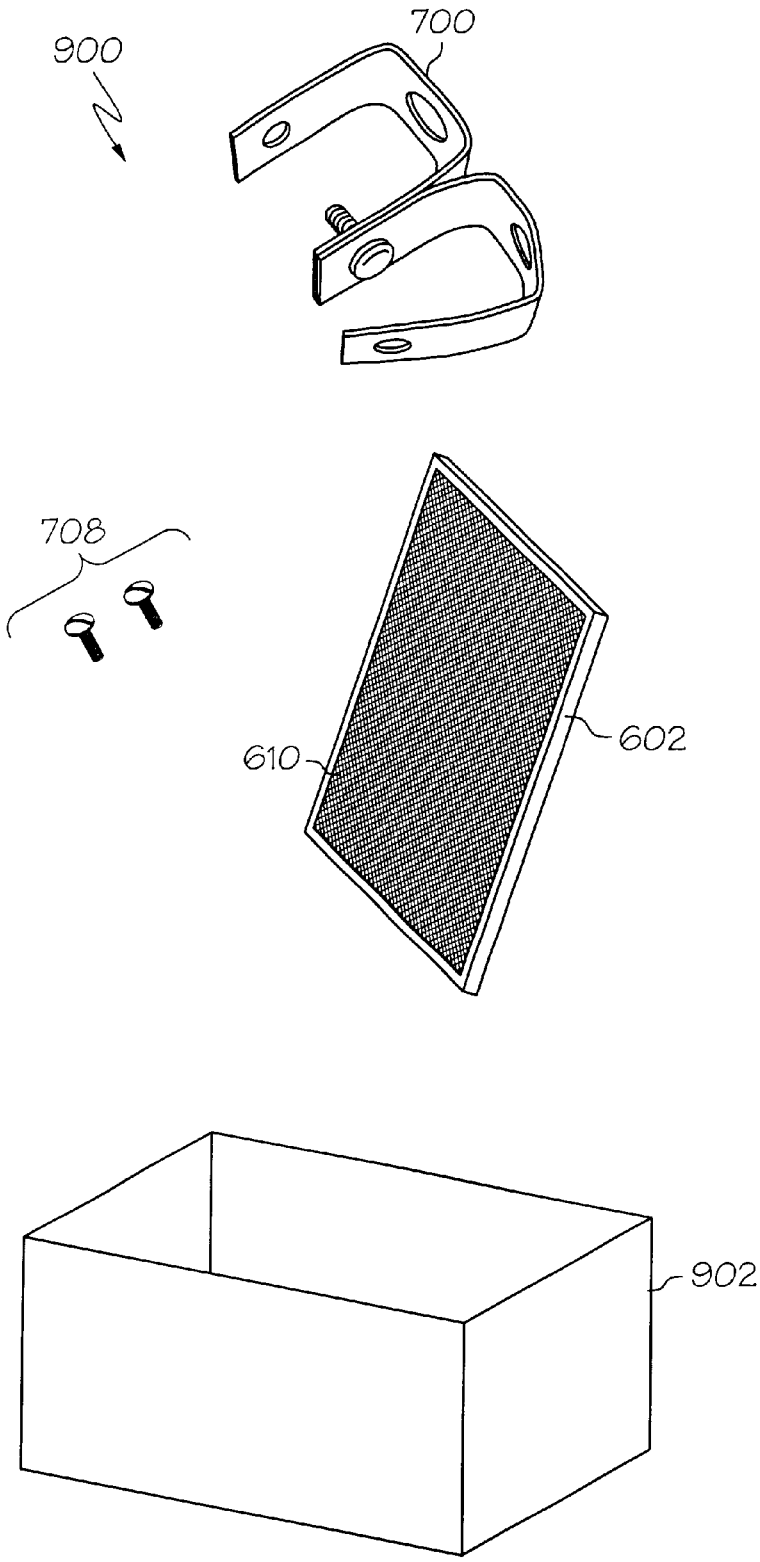
FIG. 9 illustrates an exploded view of an exemplary alternative embodiment of a kit that may be used to modify the air conditioning unit depicted in FIG. 1.

In one embodiment, the shading systems 200, 600 may be obtained as a kit. Examples of such kits are illustrated in FIGS. 8 and 9, respectively. Preferably, each kit 800, 900 includes, respectively, one or more suitably shaped frames 202, 602, one or more sheets of solar screen material 210, 610, appropriate bracketing 302, 402, 700, and may additionally include mounting hardware, such as screws 310, 708. Although the sheets of solar screen material 210, 610 are depicted as being pre-coupled to the frame 202, 602 as part of the kit 800, 900, it will be appreciated that the person installing the system 200, 600 may have to couple the material 210, 610 to the frame 202, 602. Additionally, while it is preferable that the frames 202, 602 are pre-assembled, the installer may also need to assemble these components, as well. Each kit 800, 900 may also include other appropriate tools and/or components necessary to install the system 200, 600 on the unit 100. The kits 800, 900 may also include an appropriate container 802, 902 for shipping, storage, or other purposes.

As noted above, the frames 202, 602 are preferably pre-assembled and the solar screen material 210, 610 is preferably pre-coupled to the frame 202, 602. Thus, to install the first system 200, one or more of the rotating brackets 302 and one or more of the adjustable length bracket assemblies 402 are each coupled to one or more sides of the air conditioning unit housing 102, preferably using one or more screws 310 and 415, respectively. A frame 202 is then snap fit into the first frame attachment brace 306 on the rotating bracket assembly 302 and into the second frame attachment brace 426 on the adjustable length bracket assembly 402. The adjustable length bracket assembly 402 may then be adjusted to the desired length so that the bottom 206 of the frame is spaced a desired distance from the air conditioning unit housing 102, and secured at this length using the fastener hardware 408. To install the second system 600, the desired number of brackets 700 are coupled to the air conditioning unit housing 102. Then, a frame 602 is slid into position within each of the frame clamping sections 706.

The system and method for shading air conditioning units described herein is relatively easy to install, relatively inexpensive, does not significantly restrict air flow into or out of the air conditioning unit, is adjustable, and attaches directly to the air conditioning unit housing.

While the invention has been described with reference to a preferred embodiment, it will be understood by those skilled in the art that various changes may be made and equivalents may be substituted for elements thereof without departing from the scope of the invention. In addition, many modifications may be made to adapt to a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

I claim:

1. A system for shading an air conditioning unit from sunlight, comprising:

at least one frame;

at least one sheet of solar screen material coupled to the frame;

at least one rotating bracket assembly coupled to a first portion of the frame for rotationally coupling the first portion of the frame to the air conditioning unit; and at least one adjustable length extension bracket assembly coupled to a second portion of frame for adjustably spacing the second portion of the frame a predetermined distance from the air conditioning unit.

2. The system of claim 1, wherein each rotating bracket assembly comprises:

a first housing attachment plate adapted for coupling the rotating bracket assembly to the air conditioning unit, the first housing attachment plate having at least one opening formed therethrough for receiving a threaded fastener therein;

a first substantially U-shaped frame attachment brace dimensioned to snap-fit onto the frame; and a first hinge rotationally coupling the first housing attachment plate and the first U-shaped frame brace together.

3. The system of claim 1, wherein each adjustable length extension bracket assembly comprises:

a first bracket having at least a first end, a second end, a top surface, and a bottom surface, the first bracket first end adapted for coupling to the second portion of the frame;

a second bracket having at least a first end, a second end, a top surface, and a bottom surface, the second bracket first end adapted for coupling to the air conditioning unit;

a slot formed through the second bracket between the second bracket top and bottom surfaces and extending from a predetermined position proximate the second bracket first end to a predetermined position proximate the second bracket second end; and a fastener coupled to the first bracket and extending through the slot for securing the first and second brackets at predetermined positions relative to one another, whereby the frame is spaced the predetermined distance from the air conditioning unit.

4. The system of claim 3, further comprising:

a second housing attachment plate adapted for coupling the first bracket to the air conditioning unit, the second housing attachment plate having at least one opening formed therethrough for receiving a threaded fastener therein;

a second hinge rotationally coupling the second housing attachment plate and the first end of the first bracket together;

a second substantially U-shaped frame attachment brace dimensioned to snap-fit onto the frame; and a third hinge rotationally coupling the second U-shaped frame brace and the second bracket first end together.

5. A system for shielding an air conditioning unit from sunlight, comprising:

at least one frame;

at least one sheet of solar screen material coupled to the frame;

at least two brackets, each bracket adapted to slidably receive at least a portion of the frame therein and to couple the bracket to the air conditioning unit.

6. The system of claim 5, wherein each bracket comprises:

a first main body portion having at least a first end and a second end, the first end having an opening therethrough for receiving a fastener therein, and the second end spaced a predetermined distance from the first end; and a substantially U-shaped second main body portion coupled to the first main body portion second end, the second main body portion adapted for slidably receiving the portion of the frame therein.

7. A kit for modifying an air conditioning unit to include a system for shading the air conditioning unit from sunlight, the kit comprising:

at least one frame;

at least one sheet of solar screen material;

at least one rotating bracket adapted for rotationally coupling a first portion of the frame to the air conditioning unit; and at least one adjustable extension bracket adapted for coupling a second portion of frame to the air conditioning unit.

8. The kit of claim 7, wherein the sheet of solar screen material is coupled to the frame.

9. A kit for modifying an air conditioning unit to include a system for shielding the air conditioning unit from sunlight, the kit comprising:

at least one frame;

at least one sheet of solar screen material; and at least two brackets, each bracket adapted to slidably receive at least a portion of the frame therein and to couple the bracket to the air conditioning unit.

10. The kit of claim 9, wherein the sheet of solar screen material is coupled to the frame.

11. A method of installing a system for shading an air conditioning unit from sunlight, comprising:

providing at least one frame having at least one sheet of solar screen material coupled thereto;

providing at least one rotating bracket adapted for rotationally coupling a first portion of the frame to the air conditioning unit;

providing at least one adjustable length extension bracket adapted for coupling a second portion of frame to the air conditioning unit;

coupling the rotating bracket to the air conditioning unit;

coupling the adjustable length extension bracket to the air conditioning unit;

coupling the rotating bracket to the frame first portion; and coupling the adjustable extension bracket to the frame second portion.

12. The method of claim 11, further comprising:

adjusting the adjustable length bracket to thereby space the frame second portion a predetermined distance from the air conditioning unit.

13. A method of installing a system for shading an air conditioning unit from sunlight, comprising:

providing at least one frame having at least one sheet of solar screen material coupled thereto;

providing at least two brackets adapted for coupling to the air conditioning unit, each bracket including a first portion adapted to slidably receive at least a portion of the frame therein;

coupling the brackets to the air conditioning unit; and slidably inserting the frame into the first portion of each of the brackets.

* * * * *